US006354965B1

(12) United States Patent
Harris et al.

(10) Patent No.: US 6,354,965 B1
(45) Date of Patent: Mar. 12, 2002

(54) GOLF BALLS INCLUDING LOW WATER ACTIVITY FLUID AND METHODS FOR MAKING SAME

(75) Inventors: Kevin M. Harris, New Bedford; David A. Bulpett, Boston; Douglas E. Jones; Shenshen Wu, both of N. Dartmouth, all of MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/496,353

(22) Filed: Feb. 2, 2000

(51) Int. Cl.[7] ..... A63B 37/08; A63B 37/06; A63B 37/00

(52) U.S. Cl. ..... 473/354; 473/357; 473/351

(58) Field of Search ..... 473/351, 354, 473/357, 361, 362, 363, 364, 365, 371, 376, 377

(56) References Cited

U.S. PATENT DOCUMENTS

| | | | | |
|---|---|---|---|---|
| 4,244,855 A | | 1/1981 | Cox et al. | |
| 4,783,857 A | | 11/1988 | Suzuki et al. | |
| 5,340,112 A | | 8/1994 | Hamada et al. | |
| 5,421,580 A | | 6/1995 | Sugimoto et al. | |
| 5,496,035 A | | 3/1996 | Gilchrist et al. | |
| 5,511,791 A | * | 4/1996 | Ebisuno et al. | 473/354 |
| 5,597,365 A | | 1/1997 | Yamada et al. | |
| 5,605,512 A | | 2/1997 | Yamada et al. | |
| 5,609,532 A | | 3/1997 | Chikaraishi | |
| 5,655,977 A | | 8/1997 | Kakiuchi et al. | |
| 5,674,137 A | | 10/1997 | Maruko et al. | |
| 5,677,054 A | | 10/1997 | Kakiuchi | |
| 5,683,311 A | | 11/1997 | Kakiuchi | |
| 5,683,312 A | | 11/1997 | Boehm et al. | |
| 5,685,785 A | | 11/1997 | Kakiuchi et al. | |
| 5,792,008 A | | 8/1998 | Kakiuchi | |
| 5,816,937 A | | 10/1998 | Shimosaka et al. | |
| 5,816,938 A | | 10/1998 | Kakiuchi | |
| 5,816,939 A | | 10/1998 | Hamada et al. | |
| 5,823,888 A | | 10/1998 | Maruko et al. | |
| 5,827,133 A | | 10/1998 | Chang | |
| 5,836,831 A | | 11/1998 | Stanton et al. | |
| 5,836,832 A | | 11/1998 | Boehm et al. | |
| 5,846,142 A | | 12/1998 | Kakiuchi et al. | |
| 6,193,618 B1 | * | 2/2001 | Sullivan et al. | 473/373 |
| 6,244,977 B1 | * | 6/2001 | Sullivan et al. | 473/372 |
| 6,287,216 B1 | * | 9/2001 | Boehm | 473/354 |

FOREIGN PATENT DOCUMENTS

| | | |
|---|---|---|
| GB | 2 299 516 A | 10/1996 |
| GB | 2 299 588 A | 10/1996 |
| GB | 2 300 125 A | 10/1996 |
| JP | 4126168 A | 4/1992 |
| JP | 11076462 A | 3/1999 |
| WO | WO 97/12648 | 4/1997 |
| WO | WO 98/02213 | 1/1998 |

OTHER PUBLICATIONS

R. Gavara et al., "The Effect of Water on the Transport of Oxygen Through Nylon–6 Films," *Journal of Polymer Science: Part B: Polymer Physics*, 32:2375–2382 (1994).

R. Hernandez, "Modeling The Sorption Of Water And The Effect Of Sorbed Water On The Solubility And Diffusivity Of Oxygen In An Amorphous Polyamide," A Dissertation, Submitted to Michigan State University, Dept. of Chemical Engineering, Degree Date: 1989, UMI Dissertation Services, Order No. 8916486.

* cited by examiner

*Primary Examiner*—Paul T. Sewell
*Assistant Examiner*—Alvin A. Hunter, Jr.
(74) *Attorney, Agent, or Firm*—Swidler Berlin Shereff Friedman, LLP

(57) ABSTRACT

Golf balls having two or more layers, one of which includes low water activity fluids, to inhibit or prevent weight loss through fluid loss, as well as methods of preparing such golf balls.

22 Claims, 2 Drawing Sheets

GOLF BALLS INCLUDING LOW WATER ACTIVITY FLUID AND METHODS FOR MAKING SAME

FIELD OF THE INVENTION

The present invention relates to golf balls, or portions thereof, having fluid-filled centers with a low water activity to inhibit or prevent weight loss through fluid loss, as well as methods of preparing the same.

BACKGROUND OF THE INVENTION

Conventional golf balls can be divided into several general classes: (a) solid golf balls having one or more layers, and (b) wound golf balls. Two-piece balls are constructed with a generally solid core and a cover and are generally the most popular with recreational golfers because they are very durable and provide maximum distance. Balls having a two-piece construction are commonly formed of a polymeric core encased by a cover. Typically, the core is formed from polybutadiene that is chemically crosslinked with zinc diacrylate and/or other similar crosslinking agents. These balls are generally easy to manufacture, but are regarded as having limited playing characteristics. Solid golf balls also include multi-layer golf balls having a solid core of one or more layers and/or a cover of one or more layers. These balls are regarded as having an extended range of playing characteristics.

Wound golf balls are generally preferred by many players due to their high spin and soft "feel" characteristics. Wound golf balls typically include a solid, hollow, or fluid-filled center, surrounded by a tensioned elastomeric material and a cover. Wound balls generally are more difficult and expensive to manufacture than solid two-piece balls.

Fluid-filled golf balls, which typically consist of a liquid surrounded by an encapsulating shell further surrounded by a wound layer and one or more cover layers, are often desired for their improved characteristics for short-game shots with irons and putters even though they tend to be more expensive to manufacture and to have a shorter lifespan. Fluid-filled golf balls typically include water to facilitate processing and manufacture, however, water and water-based liquids in golf balls can migrate out of the ball. The encapsulating shell may consist of materials that substantially inhibit the migration of the fluid, but in some cases may not. Various types of fluid-fillings for use in conventional golf balls are discussed in more detail below.

U.S. Pat. No. 5,421,580 discloses a thread-wound golf ball having a liquid-filled center, rubber thread layer formed on the liquid-filled center, and a cover covering the thread layer. The liquid-filled center may be a conventional paste, such as a mixture of water, glycerin, clay, and barium sulfate, and has a diameter of 29.5 mm to 32 mm.

U.S. Pat. No. 5,496,035 discloses a liquid-filled center golf ball having a spherical polymeric shell that contains a liquid mixture of water and a water soluble poly(ethylene oxide) polymer.

U.S. Pat. No. 5,511,791 discloses a thread-wound golf ball having a liquid-filled center containing a paste with a viscosity of 15 to 70 poise at 23° C. measured by a type B viscometer. The paste may be prepared by formulating freezing-point depressants, such as glycerine, fillers for adjusting specific gravity, viscosity modifiers, etc., in water.

UK Patent Application No. 2,299,588 A discloses wound golf balls having a center of diameter A of 26 mm to 32 mm and a specific gravity D, where D meets the following relationship: $1.0 \leqq D \leqq 0.9446*A+0.0215*A^2-0.00014*A^3+14.12$. The center may be solid or liquid-filled, but a liquid-filled center is preferred and the liquid may be selected from well-known liquids, for example, water and mixtures of water with barium sulfate, sodium sulfate, or ethylene glycol.

UK Patent Application No. 2,300,125 A discloses a thread-wound golf ball having a liquid-filled center, preferably water, with a specific gravity preferably of 1.0 to 2.0 and a diameter D of 26 mm to 32 mm. The golf ball meets the relationship $(A*B)/D \leqq 4.5$, where A is the thickness of the rubber bag [shell] containing the liquid and B is the hardness of the bag measured on the JIS-A scale, and the hysteresis loss of the liquid-filled center is up to 7% when the liquid-filled center is deformed to 50% of its diameter D.

U.S. Pat. No. 5,597,365 discloses a thread-wound golf ball having a center of a rubber bag [shell] containing a liquid of, for example, 100 parts by weight water, 5 to 20 parts by weight of a freezing-point depressant, e.g., glycerin, ethylene glycol, etc., 50 to 100 parts by weight of a filler, e.g., barium sulfate, and 10 to 30 parts by weight of a viscosity modifier, e.g., clay. The golf ball is disclosed to have improved characteristics due to the moment of inertia at 23° C. is 75 to 80 $gcm^2$ and the rate of increase of the moment of inertia at −30° C. compared to that at 23° C. is within 2 percent.

U.S. Pat. No. 5,605,512 discloses a thread-wound golf ball having center bag [shell] filled with a liquid. The liquid-filled center is prepared by pouring a liquid into a mold cooled with refrigeration medium, freezing the liquid to make a spherical core, or by pouring a liquid into a crosslinked rubber bag [shell] using a syringe and sealing a mark formed by the injection. This liquid-filled center is frozen and a thread wound in a stretched state around the liquid-filled center, which may be a conventional liquid such as water or paste with barium sulfate, clay, and glycerine dissolved in water. The rubber bag may be made from 10 to 80 weight percent 1,4-cis-polybutadiene and 90 to 20 weight percent natural rubber or cis-isoprene rubber; a metal salt of an unsaturated carboxylic acid; and a peroxide crosslinking agent.

U.S. Pat. No. 5,609,532 discloses a thread-wound golf ball having a solid or liquid-filled center. The liquid-filled center is a bag filled with water or paste obtained by adding barium sulfate and a minor amount of ethylene glycol to water. The center has a diameter of 24 mm to 33 mm, weighs less than 8 grams, and has a specific gravity of less than 0.9.

Publication WO 97/12648 discloses golf balls having a hollow, spherical shell of a polymeric material; a unitary, noncellular core that is a liquid when introduced to the core; and a spherical cover. The liquid may be a gel, such as gelatin, hydrogel, or water/methyl cellulose gel; a hot-melt, such as salt in water or oils or colloidal suspensions; or liquid, such as inorganic salt water solution, hydraulic oils.

U.S. Pat. No. 5,674,137 discloses a thread wound golf ball having a conventional liquid-filled center or solid center. The liquid-filled center liquid preferably is water with a specific gravity of at least 0.9 to 1.5 and may include 4 to 60 weight percent of a fine powder, such as barium sulfate, zinc oxide, or silica and preferably with a mean particle size of 0.02 to 100 $\mu m$ to adjust the specific gravity to this range. U.S. Pat. No. 5,655,977 discloses a similar thread wound golf ball where the liquid has a specific gravity is 1.08 to 2.00 at 23° C. and a viscosity of 1 cPs to 10,000 cPs.

U.S. Pat. No. 5,683,311 discloses a thread wound golf ball having a center bag [shell] filled with a liquid, thread rubber, and a cover. The center bag [shell] preferably has an inner diameter of 24.8 mm to 28.4 mm, a thickness of 1.5 mm to 3.0 mm, and an outer thickness of 29 mm to 33 mm. The bag [shell] is filled with 8 to 12 $cm^3$ of fluid, which can be selected from well-known liquids, such as water; mixtures of water with fine powder, such as barium sulfate, zinc white, and silica; and mixtures of water with sodium sulfate. The water should be at least 50 weight percent of the liquid in the center bag [shell] and have a specific gravity of 1.0 to 2.0.

U.S. Pat. No. 5,683,312 discloses a golf ball having a fluid mass at the center; a first, solid, non-wound mantle layer surrounding the fluid; a second, solid, non-wound mantle layer surrounding the first; and a cover. The fluid may be varied to impart a viscosity and specific gravity as desired to provide desired parameters, such as spin rate, spin decay, compression, and initial velocity. The fluid may be air, water solutions, gels, foams, hot-melts, or even a reactive liquid system that combines to form a solid, and the fluid typically has a viscosity of less than 10 cPs up to 1500 cPs.

Publication WO 98/02213 discloses a golf ball that includes a seamless shell to contain an inert gas above atmospheric pressure, such as nitrogen, helium, and argon. The plastic shell can be a thermosetting resin, thermoplastic material, or an elastomer, but the shell is preferably thermoplastic ionomer.

U.S. Pat. Nos. 5,792,008 and 5,816,938 disclose a wound golf ball having a liquid-filled or paste center in the form of a center bag [shell] filled with a liquid or paste, a thread rubber layer, and a cover. The liquid is water or paste and has a viscosity of 1 cPs to 500 cPs at 20° C., and the center has a diameter (D) of 26 to 32 mm. The reference is directed to a formula $(A*B/D) \leqq 4.5$, which should be up to 7% when the center is deformed to 50% of its diameter, where A is gage in mm and B is JIS A hardness of the center bag preferably having a thickness of 1.5 to 3.0 mm. The liquid may include sodium sulfate, aluminum chloride, barium chloride, calcium chloride, copper sulfate, ferrous sulfate, potassium chloride, potassium nitride, or magnesium chloride.

U.S. Pat. No. 5,816,937 discloses a golf ball having a multilayer cover that may include a liquid-filled center, preferably of water, having a specific gravity of 1.0 to 2.3. Additional fillers disclosed for use with the water include barium sulfate, zinc oxide, and silica, as well as a surfactant that may include dodecylbenzenesulfonic acid and sodium dodecylbenzenesulfonate. The rubber bag [shell] may be made of any well-known composition.

U.S. Pat. No. 5,827,133 discloses a golf ball having a reduced spin rate that includes a lubricating layer between the core and the cover. The core is preferably a fluid of either a liquid or gelatinous substance that will not respond to any initial spin imparted to the outer cover and will thereby retard the spin rate of the ball. Suitable liquid materials include several visco-elastic materials, petroleum-based lubricant, or synthetic lubricants, such as mineral oil, polyglycol, and glycerin, and may also include a filler to adjust the specific gravity, such as lead.

U.S. Pat. No. 5,836,831 discloses a brief history of various liquid-filled golf balls, materials for use therein, and processes for making the same. The reference also discloses a variety of thermoplastic materials suitable for use in the envelope or bag [shell] used to contain the liquid in a golf ball.

U.S. Pat. No. 5,846,142 discloses wound golf balls having a wound core and a cover, wherein the core may be solid or a liquid selected from well-known liquids, for example, water and mixtures of water with barium sulfate, sodium sulfate, or ethylene glycol. The liquid is placed in a hollow spherical center bag [shell] made of a conventional rubber composition. The liquid-filled center is disclosed to have a weight in the range of 14 to 23 grams.

As noted above, however, water permeation from the center to the exterior of fluid-filled golf balls is a concern, since a loss of weight tends to occur upon extended storage, especially under low-humidity conditions.

One approach to eliminating or reducing water migration through the ball is the selection of fluid-filled center shell compositions. Different materials vary widely in the rate at which they allow migration and material suppliers frequently supply customers with data regarding the permeation rate and/or the moisture vapor transmission rate ("MVTR") of their polymers. Within a particular family of polymers, for example SURLYN ionomers from E. I. DuPont de Nemours of Wilmington, Del. or PEBAX polyether-amide block copolymers from Elf Atochem of Philadelphia, Pa., the MVTR varies with another material property such as hardness. Though some materials may offer desirable properties, they may be possessed of an undesirably high permeation rate or MVTR. Conversely, materials with low permeation rates or MVTRs may have another undesirable property such as excessive hardness.

It is thus desired to prepare improved fluid-filled golf balls, or portions thereof, having reduced weight loss without a significant accompanying loss in golf ball performance characteristics by means of altering the fluid rather than the accompanying shell.

SUMMARY OF THE INVENTION

All of the embodiments according to the invention below may be used in any fluid-filled golf ball.

The invention relates to a golf ball core including a fluid-filled portion having a fluid having a water activity less than about 0.9, and an encapsulating shell including at least one layer which surrounds the fluid-filled portion. In a preferred embodiment, the water activity is less than about 0.8. In a more preferred embodiment, the water activity is less than about 0.6.

In yet another embodiment, the golf ball includes an additional layer disposed about the shell to act as a cover. In a preferred embodiment, the golf ball core includes at least one intermediate layer about the shell and the golf ball further includes a cover layer disposed about the shell. In this embodiment, the at least one intermediate layer may include a tensioned elastomeric material or a solid layer. In one embodiment, the fluid-filled portion includes from about 0.1 $cm^3$ to 20 $cm^3$ of fluid. In a preferred embodiment, the fluid-filled portion includes from about 2 $cm^3$ to 15 $cm^3$ of fluid. In a more preferred embodiment, the fluid-filled portion includes from about 6 $cm^3$ to 10 $cm^3$ of fluid. In yet another embodiment, the shell comprises a thickness from about 5 mils to 500 mils. In another embodiment, the shell is a single layer. In still another embodiment, the shell includes at least one of polyisoprene; natural rubber; a polyether-amide copolymer; a polyether-ester copolymer; or a combination thereof.

In another embodiment, the fluid includes water and a water activity reducing component present in an amount sufficient to inhibit loss of water from the fluid-filled portion. In one embodiment, the water activity reducing component includes at least one of trimethylglycine, 1-carboxy-N,N,N-trimethylmethanaminium hydroxide inner salt, (carboxymethyl)trimethylammonium hydroxide inner salt, glycine betaine, glycocoll trimethylglycine, lycine, oxyneurine, trimethylglycine hydroxide inner salt, trimethylglycocoll anhydride, trimethylglycine hydroxide, 1-carboxy-N,N,N- trimethylmethanaminium chloride, betaine aldehyde chloride, betaine, citrate, betaine ethyl ester chloride, betaine hydrazide hydrochloride, betaine hydrochloride, betaine monohydrate, betaine phosphate, glycerin, sodium aspartate, polydextrose, $K_2C_2H_3OH$, $K_2CO_3$, $K_2NO_3$, $K_2SO_4$, KBr, KCl, KI, KOH, LiBr, LiCl, LiI, $Mg(NO_3)_2$, $MgCl_2$, $(NH_4)_2SO_4$, NaBr, NaCl, NaI, $NaNO_3$, or $ZnBr_2$. In a preferred embodiment, the water activity reducing component includes at least one of trimethylglycine and sodium chloride.

In another embodiment, the water in the solution is present in an amount from about 30 to 70 weight percent of the total fluid. In another embodiment, the water activity reducing component is present in an amount from about 5 to 90 weight percent of the fluid.

The invention also relates to a method of forming a golf ball core by providing a fluid-filled portion including a fluid that has a water activity less than about 0.9, and containing the fluid in an envelope or shell. In a preferred embodiment, the containing properties of the shell reduces the permeation of the fluid so that less than about 0.4 g of fluid is lost from the fluid-filled center after 120 hours at 110° F.

The invention also encompasses a golf ball including a fluid-filled portion having a fluid with a water activity less than about 0.9, a shell including at least one layer that surrounds the fluid-filled portion to inhibit permeation of the fluid through the shell and having an permeation rate of less than about 1,000 (g·mil)/(100 $in^2$·day), and a cover disposed about the shell and having a dimple coverage of greater than about 60 percent, a hardness from about 35 to 80 Shore D, and a flexural modulus of greater than about 500 psi, wherein the golf ball has a compression from about 55–120 and a coefficient of restitution of greater than about 0.7.

BRIEF DESCRIPTION OF THE DRAWINGS

Further features and advantages of the invention can be ascertained from the following detailed description that is provided in connection with the drawing(s) described below.

DEFINITIONS

Figure 1:
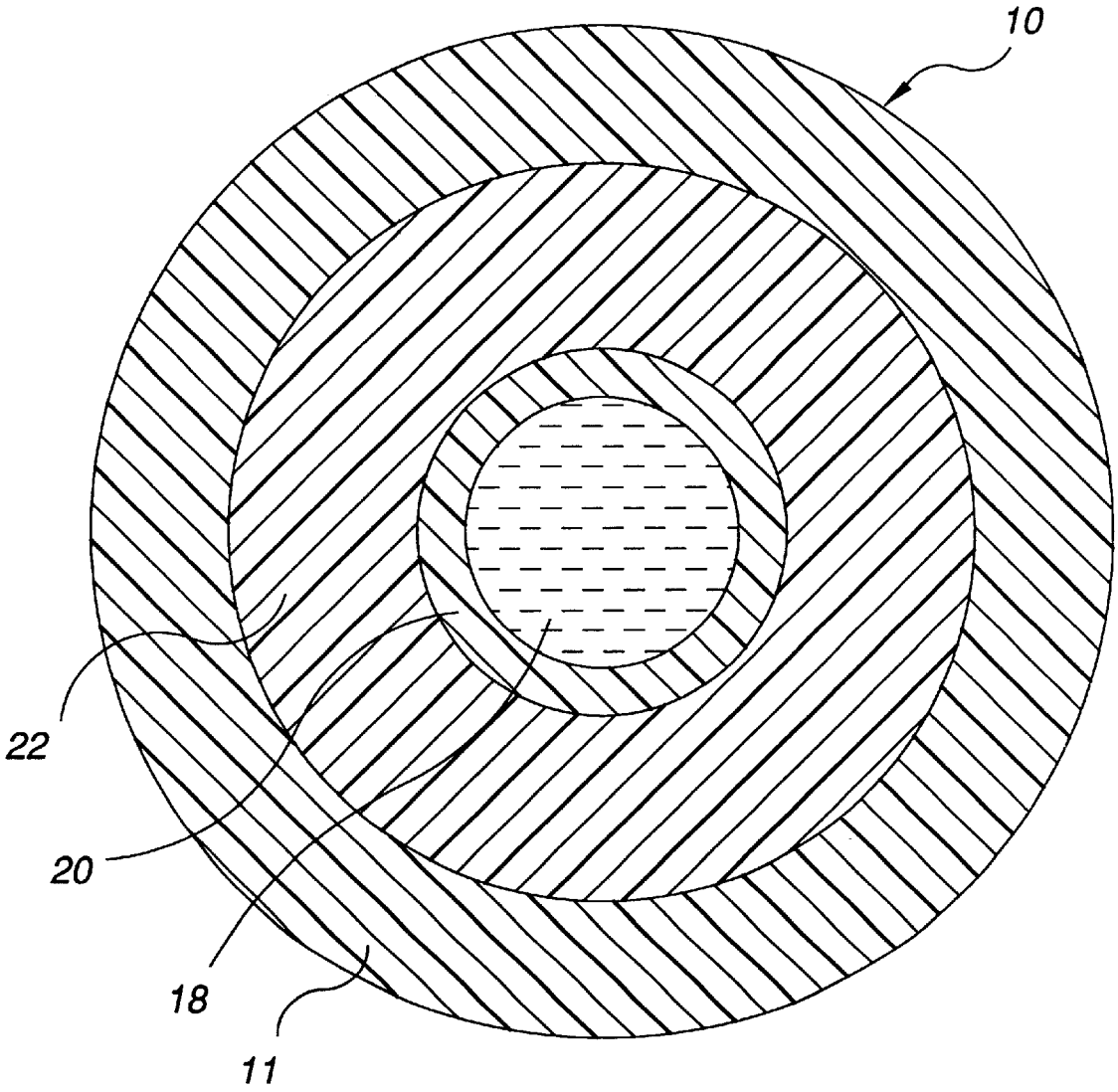
FIG. 1 is a cross-section of a golf ball having an intermediate layer between a cover and a fluid-filled core according to the invention.

The term "about," as used herein in connection with one or more numbers or numerical ranges, should be understood to refer to all such numbers, including all numbers in a range.

As used herein, the term "Atti compression" is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. When referring to the compression of a core, however, it is preferred to use a compressive load measurement.

As used herein, the term "coefficient of restitution" for golf balls is defined as the ratio of the rebound velocity to the inbound velocity when balls are fired into a rigid plate. The inbound velocity is understood to be 125 ft/s.

The term "envelope," as used herein, is interchangeable with other terms such as "shell" or "rubber bag" and is used to describe the component surrounding and in immediate contact with the fluid.

The terms "fluid" and "fluid-filled," as used herein, include, but are not limited to, liquids, gases, pastes, gels, and any combination thereof.

The term "multilayer," as used herein, means at least two layers and includes fluid-filled balls, wound balls, hollow-center balls, and the like.

The term "permeation rate," as used herein, means the permeability coefficient of water vapor through a shell, or envelope, material when measured at 37.8° C. and 100% relative humidity. Permeation rate herein is measured according to ASTM-F1249, as modified using test material slabs having a thickness of approximately 20 mils.

The term "water activity," as used herein, means the vapor pressure of water in the fluid-filled center divided by the vapor pressure of pure water. A value of 1.000 is assigned to pure, deionized water.

DETAILED DESCRIPTION OF THE INVENTION

The present invention relates to golf balls having at least a fluid-filled core and a cover. In a two-piece golf ball, a cover is disposed about the fluid-filled center. In a golf ball having three or more layers, i.e., a fluid-filled center, at least one intermediate layer, and a cover, the fluid is in the center or at least one of the intermediate layers, preferably in the center.

The loss of water or other materials from the ball via evaporation or other transport phenomenon often results in undesirable weight loss of the fluid from such golf balls. It has now been discovered that low water activity fluids advantageously have lower fluid transmission rates through the surrounding golf ball layers, which reduces weight loss and/or permits the use of thinner surrounding layers or types of encapsulating materials having a higher permeation rate than previously believed acceptable. Moreover, the benefits of aqueous solutions during processing and the range of temperatures for playability are retained while the disadvantage of permeation and water loss can be inhibited or eliminated.

The invention encompasses any fluid having a reduced water activity to inhibit or prevent migration of the fluid out of the golf ball. Without wishing to be bound by theory, it is believed that using lower water activity fluid formulations increases the "binding" effect on the water, thereby making it more difficult for the water present in the fluid formulation to permeate out of the golf ball.

The fluid used with the invention may be any suitable fluid known to those of ordinary skill in the art, as long as they have a low water activity typically of less than about 0.9, preferably less than about 0.8, more preferably less than about 0.7, and most preferably less than about 0.6. An incidental benefit of low water activity fluids is the inhibition of any microorganisms that may be present in the fluid, such as various molds, yeasts, bacteria, and the like. Below a water activity of about 0.8, many yeasts and most molds will be inhibited; below a water activity of about 0.6, there should be no microbial proliferation. Inhibition of such microorganisms in the fluids facilitates storage and manufacturing of the fluids.

Suitable fluids include, for example, various combinations of water, corn syrup solids, and the like, as well as a water activity reducing component. It should be understood that the fluids used in the invention described herein typically include an aqueous component. Any water activity reducing component is suitable for use, although this component will preferably include trimethylglycine ($C_5H_{11}NO_2$),1-carboxy-N,N,N-trimethylmethanaminium hydroxide inner salt, (carboxymethyl)trimethylammonium hydroxide inner salt, glycine betaine, glycocoll trimethylglycine, lycine, oxyneurine, trimethylglycine hydroxide inner salt, trimethylglycocoll anhydride, trimethylglycine hydroxide, 1-carboxy-N,N,N-trimethylmethanaminium chloride, betaine aldehyde chloride, betaine, citrate, betaine ethyl ester chloride, betaine hydrazide hydrochloride, betaine hydrochloride, betaine monohydrate, betaine phosphate, glycerin, sodium aspartate ($C_9H_{17}N_2NaO_6$, or SOMATYL, which is commercially available from Lipha of Lyon, FRANCE), polydextrose (LITESSE, available from Cultor U.S. Inc. having a place of business of Ardsley, N.Y.), $K_2C_2H_3OH$, $K_2CO_3$, $K_2NO_3$, $K_2SO_4$, KBr, KCl,KI, KOH, LiBr, LiCl, LiI, $Mg(NO_3)_2$, $MgCl_2$, $(NH_4)_2SO_4$, NaBr, NaCl, NaI, $NaNO_3$, $ZnBr_2$, or a combination thereof. Preferably, the water activity reducing component includes trimethylglycine ($C_5H_{11}NO_2$) 1-carboxy-N,N,N-trimethylmethanaminium hydroxide inner salt, (carboxymethyl)trimethylammonium hydroxide inner salt, glycine betaine, glycocoll trimethylglycine, lycine, oxyneurine, trimethylglycine hydroxide inner salt, trimethylglycocoll anhydride, trimethylglycine hydroxide, 1-carboxy-N,N,N-trimethylmethanaminium chloride, betaine aldehyde chloride, betaine, citrate, betaine ethyl ester chloride, betaine hydrazide hydrochloride, betaine hydrochloride, betaine monohydrate, betaine phosphate, or a combination thereof. More preferably, the water activity reducing component is trimethylglycine, also known as betaine, which is commercially available from Cultor U.S. Inc. In another embodiment, it is also preferred to use a combination of BETAINE and any suitable water activity reducing salt, preferably sodium chloride. The water present in the solution is typically present in an amount from about 30 to 70 weight percent, preferably from about 35 to 55 weight percent, and more preferably from about 40 to 50 weight percent, of the fluid. The viscosity of the fluid is typically sufficiently low to avoid processing complications, preferably below about 1,000 cPs, more preferably below about 500 cPs, and most preferably below about 100 cPs.

In one embodiment, the water activity reducing component is present in an amount from about 5 to 90 weight percent of the fluid. In other alternative embodiments, the water activity reducing component is present in amounts from about 5 to 50 weight percent, from about 10 to 40 weight percent, and from about 15 to 30 weight percent, of the fluid. It should be understood, based on the description herein, that the amount of water activity reducing component will vary depending on the type of component selected, which amount will be readily determinable to those of ordinary skill in the art.

The fluid is preferably at least substantially uniform in density, and preferably is of uniform density. Moreover, the fluids used herein should not stratify or segregate and preferably nothing will precipitate out of the fluid that might affect the uniformity of density. The specific gravity of the low water activity fluid is typically from about 1 to 1.6, preferably from about 1 to 1.4, and more preferably from about 1 to 1.3. The viscosity of the low water activity fluid is sufficiently low to provide the benefits of a fluid, typically from about 1 cPs to 10,000 cPs, preferably from about 1 cPs to 2000 cPs, and more preferably from about 1 cPs to 500 cPs.

The golf balls of the present invention will typically include from about 0.1 $cm^3$ to 20 $cm^3$, preferably from about 2 $cm^3$ to 15 $cm^3$, and more preferably from about 6 $cm^3$ to 10 $cm^3$ of fluid. When the low water activity fluid is disposed in the center of the ball, the layer of the ball immediately surrounding the fluid, which may be the shell or a part thereof, typically an intermediate layer, generally should have a thickness from about 5 mils to 500 mils, preferably from about 10 mils to 100 mils. In some golf balls, a thin shell may be used in combination with the low water activity fluid to result in the same permeation rate as a conventional ball. In other balls, a conventional thickness shell containing fewer fillers than a conventional golf ball may be used with a low water activity fluid, as the fillers are often added to decrease the fluid loss of such conventional balls. Since fillers having various densities are conventionally used, the need for less filler permits more flexibility in preparing golf balls where the filler and/or different density portion of the ball may be adjusted to a different layer of the ball to provide improved golf ball characteristics.

Any shell material capable of inhibiting or preventing fluid loss from the ball available to those of ordinary skill in the art may be used. Exemplary materials for use in the shell include thermoset or thermoplastic materials; including polyisoprene; natural rubber; a polyether-ester copolymer; castable thermoset urethanes; vinyl resins, such as those formed from polymerization of vinyl chloride or from copolymerization of vinyl chloride with vinyl acetate, acrylic esters, or vinylidene chloride; polyolefins, such as polyethylene, polypropylene, polybutylene, and copolymers such as polyethylene methacrylate, polyethylene vinyl acetate, polyethylene methacrylic or acrylic acid, polypropylene acrylic acid, or terpolymers thereof with acrylate esters and their metal ionomers; polyamides, such as poly (hexamethylene adipamide) or others prepared from diamines and dibasic acids, poly(caprolactam), PEBAX, a poly(ether-amide) block copolymer commercially available from Elf Atochem having an address in Philadelphia, Pa., and blends of polyamides with SURLYN, polyethylene or copolymers thereof, EPDM; acrylic resins; thermoplastic rubbers, such as urethanes, olefinic thermoplastic rubbers such as styrene and butadiene block copolymers or isoprene or ethylene-butylene rubber; polyphenylene oxide resins or blends thereof with polystyrene; thermoplastic polyesters, such as PET, PBT, PETG, and elastomers such as HYTREL, which is commercially available from E. I. DuPont De Nemours & Company of Wilmington, Del.; blends and alloys including polycarbonate with ABS, PBT, PET, SMA, PE elastomers, and PVC with ABS or EVA or other elastomers; blends of thermoplastic rubbers with polyethylene, polypropylene, polyacetal, nylon, polyesters, cellulose esters; metallocene catalyzed polyolefins; silicone; polybutylene terephthalate; and the like; and any combination thereof. When used in combination with the low water activity materials described herein, preferred shell materials can have higher permeation rates than conventional natural and synthetic rubber. Such shell materials include poly (ether-amide) copolymers, poly(ether-ester) copolymers; polyurethanes; metallocene catalyzed polyolefin materials, such as a maleic anhydride grafted metallocene catalyzed polyolefin; or a combination thereof. In one embodiment, the permeation rate of the shell may be less than about 1,000 (g·mil)/(100 $in^2$·day), preferably less than about 750 (g·mil)/(100 $in^2$·day), more preferably less than about 500 (g·mil)/(100 $in^2$·day). Although permeation rate is not thickness dependent for perfect materials, some materials do exhibit a difference in permeation rate at different thicknesses. For such materials, it is desirable to test samples having a thickness of approximately 20 mils merely to provide permeation values that can be compared.

Fillers may be added to the fluid or one or more other portions of the golf balls, typically as processing aids or compounds to affect rheological and mixing properties, the specific gravity (i.e., density-modifying fillers), the modulus, the tear strength, reinforcement, and the like. Any suitable filler may be used in the ball, however, fillers used in the fluid preferably do not adversely affect the water activity. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents which may be readily selected by one of ordinary skill in the art. Foamed polymer blends may be formed using blowing agents or incorporating ceramic or glass microspheres with polymer material, all of which are well known to those of ordinary skill in the art. Polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or at least one additional layer for specialty balls, e.g., a lower weight ball is preferred for a player having a low swing speed.

The one or more intermediate layers and the cover may be formed with any materials and by any means available to those of ordinary skill in the art, although preferably all such layers inhibit or prevent fluid loss from the ball. The intermediate layer(s) may include one or more wound layers, such as those having a tensioned elastomeric material wound around the fluid-filled center.

For example, particularly suitable materials for use in one or more layers of a cover, or the shell or other intermediate layer, to inhibit fluid loss include at least one of maleic anhydride grafted metallocene-catalyzed copolymer of ethylene and octene; a maleic anhydride grafted metallocene-catalyzed copolymer of ethylene and hexene; or a maleic anhydride grafted metallocene-catalyzed copolymer ethylene and butene; ethylene-glycidyl acrylate copolymers, ethylene-glycidyl methacrylate copolymers; ethylene-n-butyl-acrylate-glycidyl methacrylate terpolymers, ethylene-methyl acrylate-glycidyl acrylate terpolymers; ethylene-methyl acrylate-glycidyl methacrylate terpolymers; ethylene-n-butyl acrylate-methacrylic acid; ethylene-n-butyl acrylate-acrylic acid; ethylene-acrylate-methacrylic acid; ethylene-acrylate-acrylic acid; polyether-ester copolymers; polyester-ester copolymers; polyether-amide copolymers; polyester-amide copolymers; thermoplastic and thermoset urethanes; or an ionomer thereof; or a combination thereof.

Furthermore, a variety of methods are known for forming fluid-filled golf ball centers, such as those disclosed in U.S. Pat. No. 5,836,831, which is incorporated herein by express reference thereto. For example, thermoplastic half-shells, i.e., a single or multi-layer shell, may be prepared by compression or injection molding. The half-shells may then be joined to form hollow spheres in a number of ways, including welding, chemical bonding, RF heat sealing, induction bonding, hot wire seaming, co-injection molding, and hot melt sealing, or a combination thereof. Alternatively, the center shell may be formed by extrusion blow molding, co-extrusion blow molding or injection blow molding.

The hollow center spheres are then filled with an appropriate fluid and low water activity component according to the invention, generally an aqueous salt solution having a specific gravity of from about 1.0 to about 1.6. Filling the hollow center spheres may be carried out, for example, by piercing the surface with a needle and injecting the fluid. The hole formed may be sealed in a number of ways, including the application of adhesives that may be cured with heat or radiation, with solvent or water-based paints, hot melt adhesives, or a polymeric material. At least one additional solid or wound layer may then be applied around the fluid-filled center and the shell, using any materials and methods available to those of ordinary skill in the art to form a golf ball.

When golf balls are prepared according to the invention, they typically will have an Atti compression of at least about 40, preferably from about 55 to 120, and more preferably from about 60 to 100. Moreover, the golf balls will have a coefficient of restitution of at least about 0.7, preferably of at least about 0.75, and more preferably of at least about 0.775. The dimple coverage such golf balls is typically greater than about 60 percent, preferably greater than about 65 percent, and more preferably greater than about 70 percent. The flexural modulus of the cover on the golf balls, as measured by ASTM method D-790, is typically greater than about 500 psi, preferably is from about 500 psi to 150,000 psi. The hardness of the cover is typically from about 35 to 80 Shore D, preferably from about 40 to 78 Shore D, and more preferably from about 45 to 75 Shore D.

Figure 2:
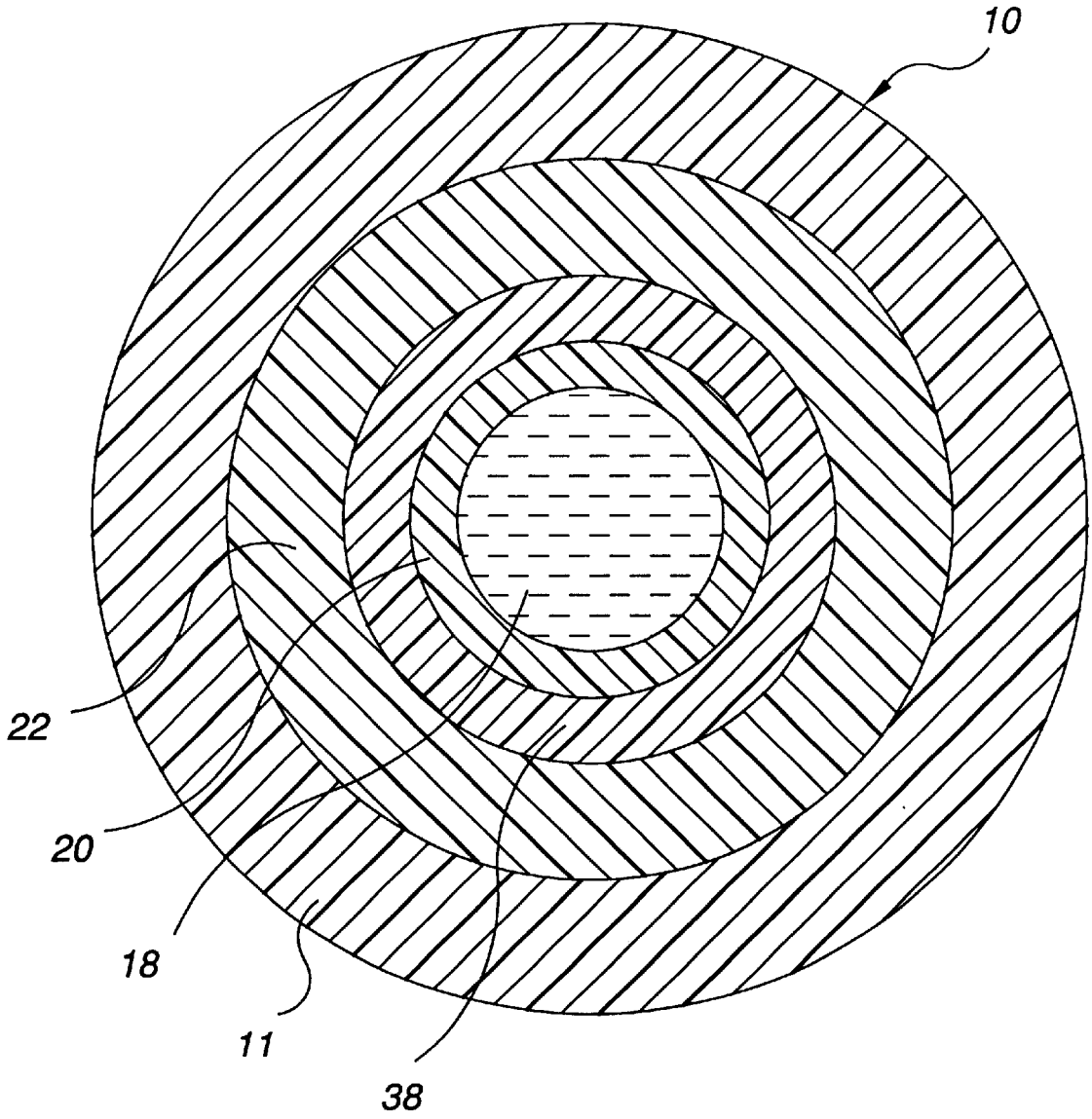
FIG. 2 is a cross-section of a golf ball having two intermediate layers between a cover and a fluid-filled core according to the invention.

FIG. 1 depicts a golf ball 10 having a fluid-filled center of a shell 20 enclosing a fluid 18 and surrounded by an intermediate layer 22 and a cover 11 to inhibit or prevent fluid loss from the center. Referring to FIG. 2, a golf ball 10 of the present invention can include a fluid-filled center of a shell 20 enclosing a fluid 18 and surrounded by a first intermediate layer 38. The first intermediate layer 38 in this embodiment is surrounded by a second intermediate layer 22, which itself is enclosed by a cover 11. The cover, one or both of the one intermediate layers, or any combination thereof, helps inhibit or prevent loss of the fluid from the core. The cover may also include more than one layer; i.e., the golf ball can be a conventional three-piece wound ball, a ball having a multi-layer center and an intermediate layer or layers, etc., although a multiple layer cover is not shown in the drawings. It will be appreciated that any number or type of intermediate layers or cover layer may be used, as desired. Typically, the core will be fluid-filled and the intermediate layer will be at least one of a polymeric or thermoplastic material to retain the fluid. It should be understood that the thickness of layers in the drawings is not necessarily to scale.

EXAMPLES

Examples 1–7

Water Activity in Conventional Golf Balls

Water activity in seven commercially available balls was determined by filling a sample cup half full with the test fluid and placing it into the Aqua Lab: Water Activity Meter (Decagon Devices, Inc. model CX3) at 23.4° C., which was calibrated beforehand at 1.000 (deionized water) and 0.250 (13.3 molal LiCl solution)±0.003 at each level. The calibration at 0.250 was also checked once during, and once after, testing the samples below and was found to be within the ±0.003 limit.

| Example | Fluid Type (Aqueous Soln's) | Water Activity |
|---|---|---|
| 1 | $BaSO_4$ paste | 0.968 |
| 2 | PVA gel | 1.003 |
| 3 | Water | 1.000 |
| 4 | $BaSO_4$ paste | 0.975 |
| 5 | PVA gel | 1.002 |
| 6 | $BaSO_4$ paste | 0.971 |
| 7 | Corn Syrup and $Na_2SO_4$ | 0.940 |

This comparative test demonstrates that all of the golf ball centers tested have a water activity of greater than 0.96, i.e., very little binding of the water in their fluid-filled filled centers occurs.

Examples 8–11

Comparison of Water Activity to Fluid Weight Loss

A control and the three fluid formulations below were each prepared in 30 golf ball centers according to the invention with a conventional thermoplastic shell material.

| Example No. | Water Activity Reducing Component (%) | Total Water (%) | Center weight loss (g)* | Ball weight loss (g)** |
|---|---|---|---|---|
| 8 (Control) | 42% Corn syrup solids<br>7% $Na_2SO_4$ | 51 | 4.69 | 0.80 |
| 9 | 20% LITESSE<br>22% BETAINE<br>15% NaCl | 43 | 3.23 | 0.44 |
| 10 | 16% Corn Syrup Solids<br>20% BETAINE<br>15% NaCl | 49 | 3.23 | 0.47 |
| 11 | 40% Corn Syrup Solids<br>10% BETAINE | 50 | 3.38 | 0.61 |

*After 11 weeks at 110° F. under 0% relative humidity
**After 15 weeks at 110° F. under 0% relative humidity Eighteen (18) fluid -filled centers of each type of fluid were subjected to oven aging at 110° F. at ambient relative humidity to determine weight loss. These centers were cut open after 11 weeks of aging. The fluid in Examples 8 and 11 was dried up, while the fluid in Examples 9–10 remained as a fluid.

Another twelve (12) balls of each type of fluid-filled center were further molded with a thermoset elastomeric cover and finished with conventional painting. These balls were conditioned in a 50% relative humidity chamber for one week, followed by oven aging for about 15 weeks with no (0%) relative humidity at 110° F.

For both the centers and the finished golf balls, the fluid-filled centers prepared according to the invention exhibited lower weight loss than a conventional fluid-filled center or golf ball.

Examples 12–15

Water Activity of Fluid According to the Invention

Several fluid solutions for use in golf balls were prepared according to the invention as follows:

| Example No. | Ingredients | Water Activity | Solution Weight loss (g)* |
|---|---|---|---|
| 12 (Control) | 42% Corn syrup solids<br>7% $Na_2SO_4$<br>51% Water | 0.909 | 0.86 g |
| 13 | 17% BETAINE<br>33% LITESSE<br>6% $Na_2SO_4$<br>44% Water | 0.824 | 0.73 g |
| 14 | 29% BETAINE<br>28% LITESSE<br>5% $Na_2SO_4$<br>38% Water | 0.731 | 0.59 g |
| 15 | 17% BETAINE<br>33% LITESSE<br>6% NaCl<br>44% Water | 0.809 | 0.7 g |

*After 240 hours at 110° F.

Thus, the fluids prepared according to the invention have reduced water activity values that renders them particularly useful for preparing golf balls. As noted above, fluids prepared according to the invention have reduced fluid loss compared to conventional fluids used in fluid-filled golf balls.

Examples 16–54

Water Activity of Additional Fluids According to Invention

Several fluid solutions for use in golf balls were prepared, each generally having a density of about 1.22–1.24 g/cm$^3$, as follows.

| Example No. | Ingredients | Water Activity |
|---|---|---|
| 16 (Prior art) | 42% Corn syrup solids<br>58% Water | 0.960 |
| 17 (Prior art) | 32% Corn syrup solids<br>5% $Na_2SO_4$<br>63% Water | 0.937 |
| 18 | 39% Corn syrup solids<br>6% NaCl<br>55% Water | 0.890 |
| 19 | 42% Corn syrup solids<br>5% NaCl<br>55% Water | 0.898 |
| 20 | 30% Corn syrup solids<br>8% NaCl<br>15% BETAINE<br>47% Water | 0.835 |
| 21 | 21% Corn syrup solids<br>13% NaCl<br>17% BETAINE<br>50% Water | 0.783 |
| 22 | 30% Corn syrup solids<br>22% BETAINE<br>8% NaCl<br>40% Water | 0.785 |
| 23 | 36% Corn syrup solids<br>6% NaCl<br>58% Water | 0.896 |
| 24 | 42% Corn syrup solids<br>6% NaCl<br>55% Water | 0.882 |
| 25 | 32% Corn syrup solids<br>5% glycerin<br>5% NaCl<br>10% BETAINE<br>48% Water | 0.839 |
| 26 | 29% Corn syrup solids | 0.820 |

-continued

| Example No. | Ingredients | Water Activity |
|---|---|---|
| | 9% NaCl<br>13% BETAINE<br>49% Water | |
| 27 | 21% Corn syrup solids<br>13% NaCl<br>17% BETAINE<br>48% Water | 0.765 |
| 28 | 63% Glycerin<br>8% NaCl<br>30% Water | 0.545 |
| 29 | 85% Glycerin<br>15% Water | 0.404 |
| 30 | 32% Corn syrup solids<br>7% NaCl<br>20% BETAINE<br>41% Water | 0.790 |
| 31 | 44% Glycerin<br>6% NaCl<br>51% Water | 0.900 |
| 32 | 80% Glycerin<br>20% Water | 0.476 |
| 33 | 75% Glycerin<br>25% Water | 0.573 |
| 34 | 70% Glycerin<br>30% Water | 0.637 |
| 35 | 68% Glycerin<br>33% Water | 0.646 |
| 36 | 65% Glycerin<br>8% NaCl<br>28% Water | 0.572 |
| 37 | 62% Glycerin<br>8.5% NaCl<br>2.5% BETAINE<br>27% Water | 0.550 |
| 38 | 62% Glycerin<br>9% NaCl<br>29% Water | 0.570 |
| 39 | 36% Corn syrup solids<br>5% Glycerin<br>6% NaCl<br>14% BETAINE<br>39% Water | 0.752 |
| 40 | 36% Corn syrup solids<br>5% Glycerin<br>6% NaCl<br>9% BETAINE<br>44% Water | 0.806 |
| 41 | 36% Corn syrup solids<br>6% NaCl<br>14% BETAINE<br>44% Water | 0.803 |
| 42 | 32% Corn syrup solids<br>10% NaCl<br>15% BETAINE<br>43% Water | 0.752 |
| 43 | 40% Corn syrup solids<br>5% NaCl<br>10% BETAINE<br>45% Water | 0.832 |
| 44 | 32% Corn syrup solids<br>10% NaCl<br>10% BETAINE<br>48% Water | 0.800 |
| 45 | 24% Corn syrup solids<br>15% NaCl<br>20% BETAINE<br>41% Water | 0.669 |
| 46 | 31% Corn syrup solids<br>5% Glycerin<br>10% NaCl<br>54% Water | 0.840 |
| 47 | 31% LITESSE<br>8% NaCl<br>23% BETAINE<br>38% Water | 0.717 |
| 48 | 42% Corn syrup solids<br>7% NaCl<br>51% Water | 0.868 |
| 49 | 52% Glycerin<br>7% NaCl<br>41% Water | 0.848 |
| 50 | 20% Glycerin<br>15% NaCl<br>22% BETAINE<br>43% Water | 0.671 |
| 51 | 20% Corn syrup solids<br>15% NaCl<br>20% BETAINE<br>45% Water | 0.688 |
| 52 | 39% Corn syrup solids<br>3% NaCl<br>20% BETAINE<br>39% Water | 0.785 |
| 53 | 37% Corn syrup solids<br>10% Glycerin<br>14% BETAINE<br>39% Water | 0.805 |
| 54 | 32% Corn syrup solids<br>10% Glycerin<br>3% NaCl<br>17% BETAINE<br>38% Water | 0.758 |

*Examples 16–17 were prepared according to the prior art, i.e., without a water reducing activity component. Moreover, numbers in this chart and all other charts herein may not add to 100% due to rounding.

Thus, compared to conventional golf ball fluids, the fluids prepared according to the invention have reduced water activity values, which renders them particularly useful for preparing golf balls.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball core comprising:

a fluid-filled portion having a fluid comprising a water activity less than about 0.9; and a shell comprising at least one layer which surrounds the fluid-filled portion to inhibit permeation of the fluid through the shell.

2. The golf ball core of claim 1, wherein the water activity is less than about 0.8.

3. The golf ball core of claim 2, wherein the water activity is less than about 0.6.

4. The golf ball core of claim 1, wherein the core further comprises at least one intermediate layer disposed about the shell.

5. The golf ball core of claim 4, wherein the at least one intermediate layer comprises a tensioned elastomeric material.

6. The golf ball core of claim 1, which further comprises at least one cover layer disposed about the core so as to form a golf ball.

7. The golf ball core of claim 1, wherein the fluid-filled portion comprises from about 0.1 $cm^3$ to 20 $cm^3$ of fluid.

8. The golf ball core of claim 7, wherein the fluid-filled portion comprises from about 2 $cm^3$ to 15 $cm^3$ of fluid.

9. The golf ball core of claim 8, wherein the fluid-filled portion comprises from about 6 $cm^3$ to 10 $cm^3$ of fluid.

10. The golf ball core of claim 1, wherein the shell comprises a thickness from about 5 mils to 500 mils.

11. The golf ball core of claim 1, wherein the shell is a single layer.

12. The golf ball core of claim 1, wherein the shell comprises polyisoprene; a polyether-amide copolymer; a polyether-ester copolymer; a urethane; or a combination thereof.

13. The golf ball core of claim 1, wherein the fluid comprises water and a water activity reducing component present in an amount sufficient to inhibit loss of water from the fluid-filled portion.

14. The golf ball core of claim 13, wherein the water activity reducing component comprises at least one of trimethylglycine, 1-carboxy-N,N,N-trimethylmethanaminium hydroxide inner salt, (carboxymethyl)trimethylammonium hydroxide inner salt, glycine trimethylglycine, glycocoll betaine, lycine, oxyneurine, trimethylglycine hydroxide inner salt, trimethylglycocoll anhydride, trimethylglycine hydroxide, 1-carboxy-N,N,N-trimethylmethanaminium chloride, betaine aldehyde chloride, betaine, citrate, betaine ethyl ester chloride, betaine hydrazide hydrochloride, betaine hydrochloride, betaine monohydrate, betaine phosphate, glycerine, sodium aspartate, polydextrose, $K_2C_2H_3OH$, $K_2CO_3$, $K_2NO_3$, $K_2SO_4$, KBr, KCl, KI, KOH, LiBr, LiCl, LiI, $Mg(NO_3)_2$, $MgCl_2$, $(NH_4)_2SO_4$, NaBr, NaCl, NaI, $NaNO_3$, or $ZnBr_2$.

15. The golf ball core of claim 14, wherein the water activity reducing component comprises at least one of trimethylglycine and sodium chloride.

16. The golf ball core of claim 13, wherein the water in the solution is present in an amount from about 30 to 70 weight of the total fluid.

17. The golf ball core of claim 13, wherein the water activity reducing component is present in an amount from about 5 to 90 weight percent of the total fluid.

18. A golf ball comprising:

a fluid-filled center having a fluid comprising a water activity less than about 0.9;

a shell comprising at least one intermediate layer surrounding the fluid-filled center to inhibit permeation of the fluid therethrough; and a cover layer disposed concentrically about the shell.

19. A method of forming a golf ball core having a fluid-filled center which comprises:

providing a fluid-filled portion having a fluid comprising a water activity less than about 0.9; and containing the fluid-filled portion in a shell to inhibit permeation of the fluid through the shell.

20. The method of claim 19, which further comprises disposing at least one cover material about the golf ball core so as to form a fluid-filled golf ball.

21. The method of claim 19, wherein the containing reduces the permeation of the fluid so that less than about 0.4 g of fluid is lost from the fluid-filled center after 120 hours at 110° F.

22. A golf ball comprising:

a fluid-filled portion having a fluid comprising a water activity less than about 0.9;

a shell comprising at least one layer which surrounds the fluid-filled portion to inhibit permeation of the fluid through the shell and having a permeation rate of less than about 1,000 (g·mil)/(100 $in^2$·day); and a cover disposed about the shell and having a dimple coverage of greater than about 60 percent, a hardness from about 35 to 80 Shore D, and a flexural modulus of greater than about 500 psi, wherein the golf ball has a compression from about 55 to 120 and a coefficient of restitution of greater than about 0.7.

* * * * *